United States Patent [19]

McCarthy et al.

[11] Patent Number: 4,626,327

[45] Date of Patent: Dec. 2, 1986

[54] ELECTROLYTIC PROCESS FOR MANUFACTURING POTASSIUM PEROXYDIPHOSPHATE

[75] Inventors: Michael J. McCarthy, Lawrenceville; John S. C. Chiang, Mercerville, both of N.J.

[73] Assignee: FMC Corporation, Philadelphia, Pa.

[21] Appl. No.: 741,933

[22] Filed: Jun. 6, 1985

[51] Int. Cl.[4] ..... C25B 1/28

[52] U.S. Cl. ..... 204/82; 204/263

[58] Field of Search ..... 204/82

[56] References Cited

U.S. PATENT DOCUMENTS

| | | | |
|---|---|---|---|
| 2,589,982 | 3/1952 | Wood et al. | 204/82 |
| 3,607,142 | 9/1971 | Mucenieks | 23/302 |
| 3,616,325 | 10/1971 | Mucenieks | 204/82 |

FOREIGN PATENT DOCUMENTS

| | | |
|---|---|---|
| 2261225 | 9/1975 | France . |
| 1089174 | 4/1984 | U.S.S.R. . |

OTHER PUBLICATIONS

Battaglia, C. et al., "The Dissociation Constants and the Kinetics of Hydrolysis of Peroxymonophosphoric Acid", Inorganic Chemistry, vol. 4, No. 4, Apr. 1965, pp. 552–558.

Tyurikova et al., "Certain Features of the Electrochemical Synthesis of Perphosphates from Phosphate Solution Without Additives", Electrokhimiya, vol. 16, No. 2, pp. 226–230.

*Primary Examiner*—T. Tung

*Attorney, Agent, or Firm*—Richard E. Elden; Robert L. Andersen; Eugene G. Seems

[57] ABSTRACT

The invention provides a process to maintain the anolyte pH in the desired range while manufacturing potassium peroxydiphosphate on a commercial scale. The process comprises electrolyzing an alkaline anolyte containing potassium, phosphate, and hydroxyl ions at a platinum or noble metal anode optionally in the presence of a reaction promoter. The catholyte, an alkali metal hydroxide, is separated from the anolyte by a separating means permeable to anions permitting hydroxyl ions to be transferred into the anolyte thereby maintaining the pH of the anolyte in the desired range.

15 Claims, 1 Drawing Figure

ELECTROLYTIC PROCESS FOR MANUFACTURING POTASSIUM PEROXYDIPHOSPHATE

Figure 1:
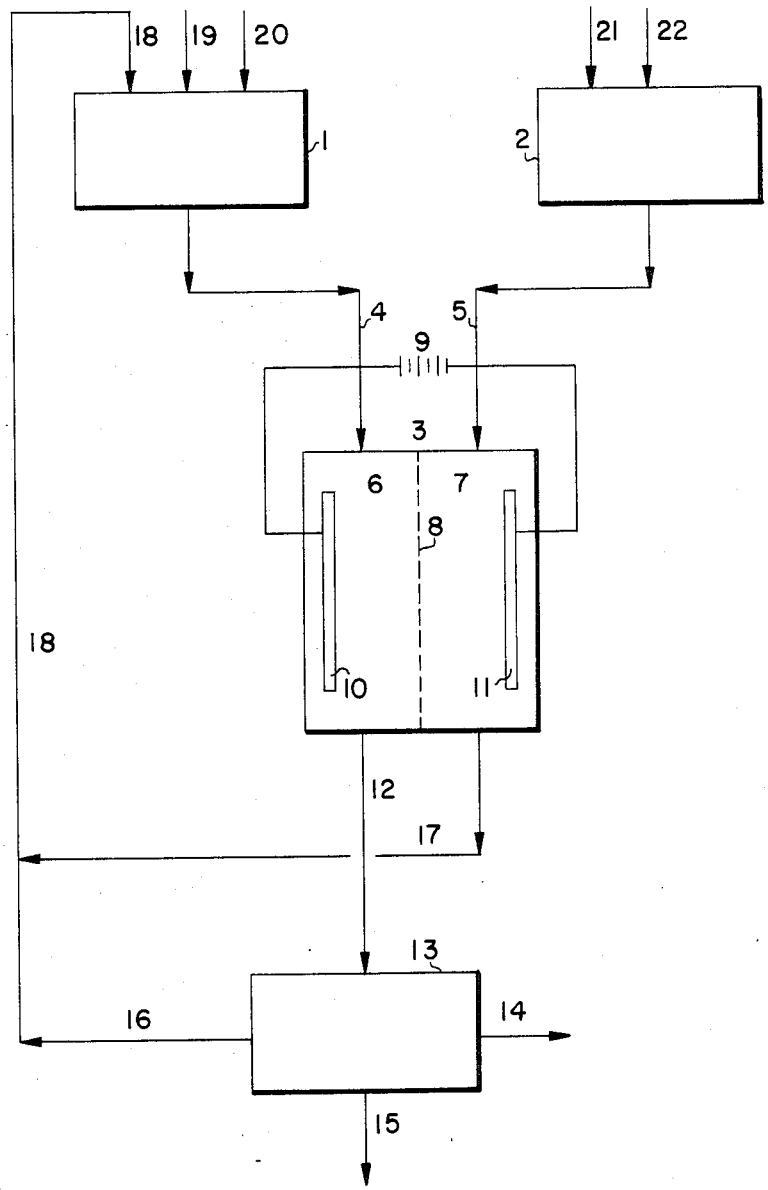

The present invention relates to an electrolytic process for manufacturing potassium peroxydiphosphate. More specifically, it relates to an electrolytic process for maintaining the pH of the anolyte in the optimum pH range for manufacturing potassium peroxydiphosphate at a high degree of conversion and a high current efficiency.

Potassium peroxydiphosphate is known to be a useful peroxygen compound, but it is not yet an article of commerce because of the difficulty of maintaining the anolyte in the desired pH range and the problems of converting an electrolytic laboratory-scale process to a commercial-scale process. The problems are based on several factors. The productivity of an electrolytic process increases directly with amperage while power loss increases with the square of the current. The predominant electrochemical reaction differs with a change in voltage, and the cost of a commercial process is a function of the total power consumed in rectifying and distributing the electrical energy and not merely on the amperage of the cell. The present invention provides a process to maintain the anolyte within the optimum pH range to produce potassium peroxydiphosphate at a high current efficiency, even when operating at a high degree of conversion.

U.S. Pat. No. 3,616,325 to Mucenieks (the "+325 patent"), incorporated herein by reference, teaches that potassium peroxydiphosphate can be produced on a commercial scale by oxidizing an alkaline anolyte containing both potassium phosphate and a fluoride at a platinum anode. The potassium phosphate catholyte is separated from the anolyte by a diaphragm. Hydrogen gas is formed at the stainless steel cathode by the reduction of hydrogen ions.

The process of the '325 patent has the disadvantage of requiring careful monitoring of the pH of the anolyte and adding potassium hydroxide thereto. The '325 patent teaches the reason for this requirement is to obtain maximum conversion of phosphate ion to peroxydiphosphate ions at high current efficiencies. The current efficiency is determined by comparing the amount of peroxydiphosphate values formed by a unit quantity of electricity with the theoretical amount of peroxydiphosphate which that amount of electrical energy can produce. The current efficiency is a separate and distinct measurement from the degree of conversion or conversion efficiency in that the latter expresses only the percent of phosphate ions converted to peroxydiphosphate ions, regardless of the quantity of electricity used to effect the conversion.

The '325 patent also teaches that as the degree of conversion increases the current efficiency decreases and the optimum pH range becomes narrower. Consequently, optimum conditions for obtaining maximum degree of conversion can be obtained either by constantly adjusting the pH of the anolyte in the electrolytic cell by the addition of KOH or by commencing operation on the alkaline side of the preferred range and continuing electrolysis until the anolyte has reached the lowest pH at which operation is desired.

French Pat. No. 2,261,225 teaches a continuous process for producing potassium peroxydiphosphate electrolytically in an alkaline potassium phosphate electrolyte containing fluoride ions. The cell employs a cylindrical zirconium cathode, a platinum anode and does not contain a means to divide the cell into a separate anode and cathode compartment. Phosphoric acid is added during electrolysis for pH control. This is because the cathode half-cell reaction increase pH of the electrolyte above the optimum range. An additional disadvantage of the French process is that peroxydiphosphate ions can be reduced at the cathode. Thus, the prior art processes either employ a separating means and require adding potassium hydroxide for anolyte pH control, or do not employ a separating means and require adding phosphoric acid for pH control.

It has now been found possible to produce potassium peroxydiphosphate without adding either potassium hydroxide or phosphoric acid to control the pH of the anolyte. In addition, the present process is capable of operating at an anode current density of at least 0.05 $A/cm^2$ and of producing potassium peroxydiphosphate at a current efficiency of at least 15% without interruption for a period of time sufficient to produce a solution containing at least 10% potassium peroxydiphosphate.

The process of the present invention is carried out as a continuous or batch process in an electrolytic cell or a plurality of electrolytic cells. Each cell has at least one anode compartment containing an anode and at least one cathode compartment containing a cathode. The compartments are separated by a separating means which prevents a substantial flow of an aqueous liquid between the anode and cathode compartments and which is substantially permeable to aqueous anions, negatively charged ions. In operation, an aqueous solution of an alkali metal hydroxide is introduced into the cathode compartment as a catholyte and an aqueous anolyte solution is introduced into the anode compartment as an anolyte, the anolyte solution comprising phosphate and hydroxyl anions and potassium cations. The hydroxyl anions are present in the anolyte in sufficient quantity to maintain the anolyte between pH 9.5 and pH 14.5. Optionally, the anolyte may also contain a reaction promoter, an additive which increases the current efficiency of the anode half-cell reaction. Suitable reaction promoters include thiourea and nitrate, fluoride, halide, sulfite and chromate anions. The catholyte may also contain other compounds which will permit the desired cathode half-cell reaction to take place. The electrolysis is effected by applying sufficient electric potential between the anode and the cathode to induce an electric current to flow through the anolyte and catholyte to oxidize phosphate ions to peroxydiphosphate ions. Anolyte containing potassium peroxydiphosphate is withdrawn from an anode compartment and, optionally, solid potassium peroxydiphosphate may be crystallized from it by any convenient method.

The anode can be fabricated from any electrically conductive material which does not react with the anolyte during electrolysis such as platinum, gold or any other noble metal.

Similarly, the cathode may be fabricated from any material which conducts an electric current and does not introduce unwanted ions into the catholyte. The cathode surface can be carbon, nickel, zirconium, hafnium, a noble metal or an alloy such as stainless steel or zircalloy. Desirably, the cathode surface will promote the desired cathode half-cell reaction, such as the reduction of water to form hydrogen gas or the reduction of oxygen gas to form hydrogen peroxide.

The cathode and anode can be fabricated in any configuration, such as plates, ribbons, wire screens, cylinders and the like. Either the cathode or the anode may be fabricated to permit coolant to flow therethrough or, alternatively, to conduct a fluid, including the anolyte or catholyte, into or out of the cell. For example, if the cathode reaction is the reduction of oxygen gas to form hydrogen peroxide, a gas containing oxygen can be introduced into the cell through a hollow cathode, or if agitation of the anolyte is desired, an inert gas can be introduced through a hollow anode.

The cells may be arranged in parallel or in series (cascade) and may be operated continuously or batchwise.

An electric potential is applied between the anode and cathode, which potential must be sufficient not only to oxidize phosphate ions to peroxydiphosphate ions, but also to effect the half-cell reduction at the cathode and to cause a net flow of ions between the anode and the cathode, for example, a flow of anions, negative ions, from cathode to anode. Normally, an anode half-cell potential of at least about 2 volts has been found operable. When the cathode reaction is the reduction of water to form hydrogen gas, an overall cell voltage of about 3 to 8 volts is preferred.

The temperature of the anolyte and catholyte is not critical. Any temperature may be employed at which the aqueous electrolyte is liquid. A temperature of at least 10° C. is desirable to prevent crystallization in the anolyte and catholyte and a temperature of 90° C. or less is desirable to avoid excessive evaporation of water from the aqueous fluids. Temperatures of from 20° C. to 50° C. are preferred and more preferably from 30° C. to 40° C.

It is desirable for the anolyte to contain sufficient phosphorus atoms to be about equivalent to a 1 molar to 4 molar (1 M to 4 M) solution of phosphate ions, preferably 2 to 3.75 molar. The ratio of the potassium to phosphorus atoms, the K:P ratio, should range from 2:1 to 3.2:1; preferably, 2.5:1 to 3.0:1.

A reaction promoter may be incorporated into the anolyte in any convenient form such as an acid, as a salt, or any other form which does not introduce a persistent ionic species into the anolyte.

It is critical for the anolyte to be maintained between pH 9.5 and pH 14.5 throughout the electrolysis. Preferably, the anolyte should be maintained between pH 12 and pH 14. The '325 patent teaches that the optimum pH range for oxidizing phosphate ions to form a peroxydiphosphate ion is very narrow, particularly when the cell is operated at a high degree of conversion. Consequently, the patent teaches that either potassium hydroxide must be added to the cell during electrolysis, or the cell must be operated part of the time outside the optimum pH range.

In the present invention, it is critical for the anode and the cathode compartments to be separated by a separating means which not only prevents a substantial flow of liquid between compartments but also is permeable to anions such as hydroxyl ions, thereby permitting an electric current to flow between the anode and cathode. For example, the separating means can be a membrane permeable only to anions such as hydroxyl or phosphate ions permitting anions to be transferred from the cathode compartment to the anode compartment, or the separating means can be a porous diaphragm permitting both cations and anions to be transferred from one compartment to the other. A diaphragm can be fabricated from any inert porous material such as a ceramic, polyvinyl chloride, polypropylene, polyethylene, a fluoropolymer or any other convenient material.

Although the concentration of the alkali metal hydroxide in the catholyte is not critical, it is desirable for the catholyte to be at least one molar (1 M) in hydroxyl ion concentration to minimize the voltage drop across the cell. Preferably, the catholyte should be at least 6 molar in hydroxyl ion concentration. The maximum concentration of the hydroxyl ion is limited only by the solubility of the alkali metal hydroxide selected for the catholyte. The concentration of the alkali metal hydroxide in the catholyte should be as high as feasible to minimize the power loss and also to minimize evaporation of water required when the potassium peroxydiphosphate is to be recovered from the anolyte.

If the electrolytic cell or plurality of cells is to be operated continuously, it is usually convenient to use potassium hydroxide as the alkali metal hydroxide in the catholyte. However, if the cathode half-cell reaction is the reduction of oxygen gas to form an alkaline hydrogen peroxide bleach solution, it is usually more economical for the alkali metal hydroxide to be sodium hydroxide. Optionally, the catholyte may contain other anions such as phosphate, thiocyanate, sulfite, nitrate or fluoride anions. When the catholyte is composed of both phosphate and hydroxyl anions, some of the phosphate anions will be transferred through the separating means into the anolyte, and there oxidized to peroxydiphosphate anions. On the other hand, if it is desirable to add reaction promoter anions to the anolyte during electrolysis, the catholyte can be comprised of an alkali metal hydroxide and the reaction promoter compound so that both hydroxyl anions and reaction promter anions are transferred through the separating means from the catholyte into the anolyte. This is a particularly effective means for maintaining an effective concentration of an easily oxidized reaction promoter compound in the anolyte, such as a thiocyanate.

The hydroxyl anions are known to have the greatest equivalent conductance of any ion species in either the anolyte or the catholyte. Even when only half of the anions in the catholyte are hydroxyl anions, sufficient hydroxyl anions are usually transferred from the catholyte to the anolyte to maintain the pH of the anolyte between 9.5 and 14.5. From the above, it will become clear to one skilled in the art that the pH of the anolyte can be controlled within a very narrow preferred pH limits of 12 to 14 by controlling the proportion of the hydroxyl anions to the total anions in the catholyte.

When operating in a batch mode, the transfer of hydroxyl anions from the catholyte to the anolyte provides a means to continuously adjust the pH of the anolyte without adding to the volume thereof.

FIG. 1 is a diagrammic view of one preferred embodiment of the present invention operated as a continuous process.

In FIG. 1 of the drawing, electrolytic cell 3 comprises an anode compartment 6 containing anode 10 separated by separation means 8 from cathode compartment 7 containing cathode 11. Cathode compartment 7 is connected by line 5 to catholyte feed tank 2. Feed tank 2 receives potassium hydroxide solution through line 21 from a source, not shown, and optionally a potassium phosphate or phosphoric acid solution through line 22 from a source, also not shown. Similarly, anode compartment 6 is connected by line 4 to anolyte feed tank 1. Feed tank 1 receives a potassium phosphate solution through line 20 from a source, not shown, a reaction promoter such as potassium nitrate or potassium fluoride through line 19 from a source, also not shown, and catholyte effluent. The latter is withdrawn from catholyte compartment 7 through line 17 to line 18. Anolyte effluent from anode compartment 6 is directed through line 12 to evaporative crystallizer or separator 13 wherein solid product potassium peroxydiphosphate is withdrawn from the system through line 14. The solution remaining is directed through line 16 into line 18 where it is combined with catholyte from line 17 flowing to anolyte feed tank 1. Water vapor from evaporative crystallizer or separator 13 is removed through line 15.

In operation, anode 10 and cathode 11 are connected electrically to an electromotive source represented in FIG. 1 by battery 9. At the cathode 11, water is reduced to form hydrogen gas and hydroxyl anions. The hydroxyl anions, together with the other ions in the catholyte and anolyte, conduct the electric current through separating means 8 to the anode 10 where phosphate ions are oxidized to form peroxydiphosphate. Hydroxyl anions and other anions are transferred through the separating means 8 thereby conducting electric current from the cathode compartment 7. Because of their greater mobility, the greater proportion of the current is conducted by hydroxyl ions to provide sufficient hydroxyl ions in the anolyte to maintain the desired pH therein between 9.5 and 14.5.

The best mode of practicing the present invention will be evident to one skilled in the art from the following examples. For uniformity, the examples are in terms of a cell consisting of a platinum anode immersed in an anolyte, a porous diaphragm, and a nickel cathode immersed in a potassium hydroxide catholyte. The cathode reaction is the reduction of water to form hydroxyl ions and hydrogen gas. The electrolytic cell was fabricated from methylmethacrylate resin with inside dimensions of 11.6 cm×10 cm×5.5 cm. A porous ceramic diaphragm separated the cell into anode and cathode compartments. The anode was made of platinum ribbon strips with a total surface area of 40.7 $cm^2$. The cathode was nickel with an area of about 136 $cm^2$.

EXAMPLE I

The initial phosphate concentration of the anolyte was 3.5 M and the K:P ratio was 2.65:1. The nitrate concentration was varied from 0 to 0.38 M (0 to 2.5% $KNO_3$). The initial pH of the anolyte solution was about 12.7 at room temperature. The catholyte was about 8.26 M (34.8%) KOH.

The anolyte and catholyte solutions were introduced into the cell and an electric potential of about 4.8 volts was applied causing 6.1 A current flow for 5 hours at 30° C. The anode current density was calculated to be about 0.15 A/$cm^2$. Results are tabulated as Table I which shows that the process maintains the pH of the anolyte between 9.5 and 14.5 even at a high degree of conversion (18% $K_4P_2O_8$ product assay).

EXAMPLE II

A series of anolyte solutions were prepared to contain 3.5 M/l phosphate ion and 2.5% $KNO_3$ with a K:P mol ratio varying from 2.5:1 to 3.0:1. The solutions were electrolyzed in the cell from Example I with a catholyte containing 30% KOH at a current density of 0.15 A/$cm^2$ at 30° C. The pH and $K_4P_2O_8$ assay were determined after 90, 180, 270 and 300 minutes. The data are presented as Table II.

The data show the relationship between current efficiency, $K_4P_2O_8$ concentration and K:P ratio. The current efficiency appears to vary directly with the unoxidized phosphate remaining in the solution.

It is clear from Table II that the anolyte can be maintained between pH 9.5 and pH 14.5 even when operating the cell at a high degree of conversion (high $K_4P_2O_8$ assay). Unlike the process of the '325 patent, it is not necessary to constantly adjust the pH of the anolyte by adding potassium hydroxide thereto or, in the alternative, operate part of the time outside the optimum pH range.

TABLE I

CONTROL OF ANOLYTE pH DURING ELECTROLYSIS (INITIAL ANOLYTE pH 12.7, CATHOLYTE 34.8% KOH)

| Run No. | Molarity $KNO_3$ | Current* Efficiency, % | Product* $K_4P_2O_8$, % | Final pH |
|---|---|---|---|---|
| 1 | 0.0 | 3.8 | 2.8 | 11.8 |
| 2 | 0.015 | 6.9 | 5.1 | 12.1 |
| 3 | 0.152 | 17.5 | 12.7 | 12.5 |
| 4 | 0.381 | 24.8 | 18.0 | 13.2 |

*Overall after 300 minutes at 0.15 A/$cm^2$.

TABLE II

CONTROL OF ANOLYTE pH USING AN ALKALI METAL HYDROXIDE AS A CATHOLYTE

| K:P Ratio | Min. | pH | $K_4P_2O_8$, % | Current* Efficiency, % |
|---|---|---|---|---|
| 2.5:1 | 0 | 12.08 | 0.0 | — |
| | 90 | 11.81 | 5.8 | 27.6 |
| | 180 | 11.63 | 10.1 | 18.9 |
| | 270 | 11.43 | 13.0 | 12.0 |
| | 360 | 11.20 | 14.7 | 6.5 |
| | | | | 16.3 Av. |
| 2.6:1 | 0 | 12.32 | 0.0 | — |
| | 90 | 12.12 | 7.1 | 32.3 |
| | 180 | 12.06 | 12.3 | 22.9 |
| | 270 | 11.83 | 16.2 | 16.2 |
| | 360 | 11.67 | 18.6 | 9.5 |
| | | | | 20.2 Av. |
| 2.7:1 | 0 | 12.66 | 0.0 | — |
| | 90 | 12.52 | 8.0 | 36.4 |
| | 180 | 12.48 | 13.6 | 24.3 |
| | 270 | 12.36 | 18.0 | 18.4 |
| | 360 | 12.32 | 20.9 | 11.6 |
| | | | | 22.7 Av. |
| 2.8:1 | 0 | 13.04 | 0.0 | — |
| | 90 | 12.95 | 7.9 | 37.3 |
| | 180 | 12.91 | 13.7 | 26.5 |
| | 270 | 12.80 | 18.2 | 19.6 |
| | 360 | 12.52 | 21.4 | 12.7 |
| | | | | 24.0 Av. |
| 2.9:1 | 0 | 13.57 | 0.0 | — |
| | 90 | 13.57 | 7.8 | 37.3 |
| | 180 | 13.70 | 13.6 | 26.8 |
| | 270 | 13.61 | 18.4 | 20.6 |
| | 360 | 13.49 | 22.0 | 15.1 |
| | | | | 25.0 Av. |
| 3.0:1 | 0 | 14.47 | 0.0 | — |
| | 90 | 14.65 | 7.2 | 34.7 |
| | 180 | 14.58 | 12.1 | 22.8 |
| | 270 | 14.38 | 16.6 | 19.5 |
| | 360 | 14.26 | 20.3 | 15.9 |
| | | | | 23.2 Av. |

*0.15 A/$cm^2$.

What is claimed is:

1. A process for producing potassium peroxydiphosphate in an electrolytic cell or plurality of cells, each cell comprising at least one anode compartment containing an anode and at least one cathode compartment containing a cathode, said compartments being separated by a separating means which prevents a substantial flow of an aqueous liquid between the anode compartment and the cathode compartment, such separating means being substantially permeable to an aqueous anion, comprising: introducing into the anode compartment an aqueous anolyte comprising phosphate and hydroxyl anions and potassium cations, the hydroxyl anions being present in sufficient quantity to provide an anolyte pH between 9.5 and 14.5; concomitantly providing in the cathode compartment an aqueous catholyte comprising an alkali metal hydroxide in a sufficient amount such that when a sufficient electrical potential is applied between the anode and the cathode hydroxyl anions will transfer through the separating means to maintain the anolyte between pH 9.5 and pH 14.5; and applying said sufficient electrical potential to cause phosphate anions to be oxidized at the anode to form peroxydiphosphate anions and to cause hydroxyl anions to transfer from the catholyte through the separating means to maintain the anolyte at said pH.

2. The process of claim 1 wherein the alkali metal hydroxide in the catholyte is sodium hydroxide.

3. The process of claim 1 wherein the alkali metal hydroxide is potassium hydroxide.

4. The process of claim 1 wherein the concentration of the alkali metal hydroxide in the catholyte is at least one mol per liter.

5. The process of claim 4 wherein the alkali metal hydroxide in the catholyte is sodium hydroxide.

6. The process of claim 4 wherein the alkali metal hydroxide is potassium hydroxide.

7. The process of claim 1 wherein the catholyte comprises at least one mol per liter potassium hydroxide and up to one mol of tripotassium phosphate per mol of potassium hydroxide.

8. The process of claim 1 wherein the pH of the anolyte is maintained between pH 12 and pH 14.

9. A process for preparing potassium peroxydiphosphate in an electrolytic cell or plurality of cells, each cell comprising at least one anode compartment containing an anode and at least one cathode compartment containing a cathode, said compartments being separated by separating means which prevents a substantial flow of an aqueous liquid between the anode compartment and the cathode compartment, which separating means is substantially permeable to anions, comprising: introducing into the anode compartment an aqueous anolyte which is from 1 to 4 molar in phosphate containing sufficient potassium cation to provide a K:P ratio of from 2:1 to 3.2:1, and sufficient hydroxyl anions to provide an anolyte pH between 9.5 and 14.5; concomitantly providing a catholyte in the cathode compartment comprising at least 1 mol per liter of potassium hydroxide; and applying sufficient electric potential between the anode and cathode to cause phosphate ions to be oxidized at the anode and hydroxide ions to be transferred through the separating means from the cathode compartment into the anode compartment and maintain the anolyte between pH 9.5 and pH 14.5.

10. The process of claim 9 wherein the catholyte is continuously introduced into the cathode compartment, anolyte is continuously introduced into the anode compartment and concomitantly catholyte is withdrawn from the cathode compartment and anolyte containing potassium peroxydiphosphate is withdrawn from the anode compartment.

11. The process of claim 10 wherein the anolyte introduced into the anode compartment is between 2 and 3.75 molar in phosphate anion concentration, the K:P ratio thereof is between 2.5:1 and 3.0:1 and the pH thereof is maintained between pH 12 and pH 14 by introducing at least a 6 molar solution of potassium hydroxide into the cathode compartment.

12. The process of claim 9 wherein the anolyte introduced into the anode compartment is between 2 and 3.75 molar in phosphate anion concentration, the K:P ratio thereof is between 2.5:1 and 3.0:1 and the pH thereof is maintained between pH 12 and pH 14 by introducing at least a 6 molar solution of potassium hydroxide into the cathode compartment.

13. A process for continuously producing potassium peroxydiphosphate in an electrolytic cell or plurality of cells, each cell comprising at least one anode compartment containing an anode and from at least one cathode compartment containing a cathode, the compartments separated by separating means which prevents a substantial flow of an aqueous liquid between the anode compartment and the cathode compartment, said separating means being substantially permeable to an aqueous anion, comprising: introducing into the anode compartment an aqueous anolyte which comprises potassium cations, phosphate anions and sufficient hydroxyl anions to provide an anolyte pH between 9.5 and 14.5; providing in the cathode compartment an aqueous catholyte which comprises potassium hydroxide in a sufficient amount such that when a sufficient electrical potential is applied between the anode and the cathode hydroxyl anions will transfer through the separating means to maintain the anolyte between pH 9.5 and pH 14. 5; applying said sufficient electric potential between the anode and cathode to cause phosphate anions to be oxidized at the anode to form peroxydiphosphate and cause hydroxyl anions to transfer from the catholyte through the separating means to maintain the anolyte, at said pH withdrawing from the anode compartment a portion of the anolyte containing a solution of potassium peroxydiphosphate; and withdrawing from a cathode compartment a portion of the catholyte.

14. The process of claim 13 with the added step of separating the withdrawn anolyte into solid potassium peroxydiphosphate and a liquid residue.

15. The process of claim 14 wherein withdrawn and liquid residue are incorporated into the anolyte feed.

* * * * *